US012298064B2

(12) United States Patent
Zhang et al.

(10) Patent No.: US 12,298,064 B2
(45) Date of Patent: May 13, 2025

(54) SELF-BALANCING ADJUSTABLE RACK DEVICE AND REFRIGERATOR HAVING THE SAME

(71) Applicants: QINGDAO HAIER SPECIAL REFRIGERATION ELECTRIC APPLIANCE CO., LTD., Qingdao (CN); HAIER SMART HOME CO., LTD., Qingdao (CN)

(72) Inventors: Zhenxing Zhang, Qingdao (CN); Xueli Cheng, Qingdao (CN)

(73) Assignees: QINGDAO HAIER SPECIAL REFRIGERATION ELECTRIC APPLIANCE CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 83 days.

(21) Appl. No.: 18/022,168

(22) PCT Filed: Aug. 17, 2021

(86) PCT No.: PCT/CN2021/112881
§ 371 (c)(1),
(2) Date: Feb. 19, 2023

(87) PCT Pub. No.: WO2022/037550
PCT Pub. Date: Feb. 24, 2022

(65) Prior Publication Data

US 2023/0296309 A1 Sep. 21, 2023

(30) Foreign Application Priority Data

Aug. 19, 2020 (CN) ..... 202010839288.7

(51) Int. Cl.
*F25D 25/02* (2006.01)
*F25D 23/06* (2006.01)

(52) U.S. Cl.
CPC ..... *F25D 23/067* (2013.01)

(58) Field of Classification Search
CPC .. F25D 23/067; F25D 2325/021; F25D 25/02; F25D 25/04; F25D 25/024
(Continued)

(56) References Cited

U.S. PATENT DOCUMENTS

2004/0149182 A1 8/2004 Bienick et al.
2009/0261704 A1* 10/2009 Benz ..... F24C 15/16 312/293.1

FOREIGN PATENT DOCUMENTS

CN 1319754 A 10/2001
CN 101542221 A 9/2009
(Continued)

*Primary Examiner* — James O Hansen
(74) *Attorney, Agent, or Firm* — Cheng-Ju Chiang

(57) ABSTRACT

The present invention discloses a self-balancing adjustable rack device and a refrigerator having the same; the rack device includes a rack assembly, slide rail assemblies and a synchronizing assembly, the rack assembly includes a rack body and brackets, the slide rail assemblies are arranged on two sides of the rack body in a vertical direction, the synchronizing assembly includes at least one tensioning piece and at least two pulleys, one end of the tensioning piece is fixed at an upper end of a sliding plate, and the other end of the tensioning piece is fixed at a lower end of another sliding plate in the slide rail assembly on the other side through the pulleys, such that two sides of the rack assembly can be balanced in a moving process, and meanwhile, a pulling force is provided for the rack assembly by the tensioning piece.

15 Claims, 4 Drawing Sheets

(58) Field of Classification Search
USPC ..... 312/408
See application file for complete search history.

(56) References Cited

FOREIGN PATENT DOCUMENTS

| | | | | | |
|---|---|---|---|---|---|
| CN | 201522176 | U | | 7/2010 | |
| CN | 102384632 | A | | 3/2012 | |
| CN | 102538364 | A | | 7/2012 | |
| CN | 104344675 | A | | 2/2015 | |
| CN | 104515353 | A | | 4/2015 | |
| CN | 105091486 | A | | 11/2015 | |
| CN | 106440649 | A | | 2/2017 | |
| CN | 106918190 | A | | 7/2017 | |
| CN | 206390590 | U | | 8/2017 | |
| CN | 107702424 | A | | 2/2018 | |
| CN | 107702425 | A | | 2/2018 | |
| CN | 110513941 | A | | 11/2019 | |
| CN | 210532785 | | * | 5/2020 | ..... F25D 25/02 |
| CN | 112648770 | A | | 4/2021 | |
| KR | 10-2010-0065501 | A | | 6/2010 | |
| KR | 10-2012-0005777 | A | | 1/2012 | |
| KR | 10-2014-0059020 | A | | 5/2014 | |

* cited by examiner

SELF-BALANCING ADJUSTABLE RACK DEVICE AND REFRIGERATOR HAVING THE SAME

CROSS REFERENCE TO RELATED APPLICATIONS

The present invention is a 35 U.S.C. § 371 National Phase conversion of International (PCT) Patent Application No. PCT/CN2021/112881, filed on Aug. 17, 2021, which claims benefit of Chinese Application No. 202010839288.7, filed on Aug. 19, 2020, the disclosure of which is incorporated by reference herein. The PCT International Patent Application was filed and published in Chinese.

CROSS-REFERENCE TO RELATED APPLICATION

The present application claims priority to Chinese Patent Application No. 202010839288.7, entitled "Self-balancing Adjustable Rack Device and Refrigerator Having The Same", filed on Aug. 19, 2020, the disclosure of which is incorporated herein by reference in its entirety.

TECHNICAL FIELD

The present invention relates to an adjustable rack device and a refrigerator having the same, and in particular, to a position-adjustable rack with a slide rail and a refrigerator having the same.

BACKGROUND

Currently, in order to improve an internal volume rate of a refrigerator, a plurality of liner ribs which have fixed heights and are vertically arranged are generally arranged on an inner side of a refrigerating compartment of a mainstream refrigerator, and racks are arranged at heights corresponding to the liner ribs, such that more food can be stored utilizing the racks; however, since the liner rib is fixed, when a position of the rack is adjusted, all articles on a bearing surface of the rack are required to be removed, the whole rack is then lifted, drawn out, and finally fed onto another liner rib for fixation; in this process, a user is required to continuously exert a force and keep the whole rack balanced, and once the balance of the rack is not kept, the rack may overturn, cannot be fixed to a corresponding position, and even may be damaged, which is quite inconvenient.

SUMMARY

An object of the present invention is to provide a self-balancing adjustable rack device, so as to solve technical problems that a panel cannot bear a load and two sides are difficult to balance during position adjustment of a rack.

An object of the present invention is to provide a refrigerator having the self-balancing adjustable rack device.

To achieve one of the above objects, an embodiment of the present invention provides a self-balancing adjustable rack device, comprising a rack assembly, a slide rail assembly and a synchronizing assembly, wherein the rack assembly comprises a rack body and a bracket, the slide rail assembly comprises a first slide rail assembly and a second slide rail assembly located on two sides of the rack body, the first slide rail assembly comprises a first rail groove and a first sliding plate in sliding fit with the first rail groove and fixedly connected with the bracket, the second slide rail assembly comprises a second rail groove and a second sliding plate in sliding fit with the second rail groove and fixedly connected with the bracket, and the first rail groove and the second rail groove are arranged in a vertical direction and perpendicular to the rack body, at least two stop positions are arranged in each of the first rail groove and the second rail groove, the at least two stop positions are arranged at intervals in the vertical direction, and the bracket and the stop positions can be selectively limited and fixed, the first sliding plate comprises a first upper fixing portion and a first lower fixing portion at upper and lower ends thereof respectively, and the second sliding plate comprises a second upper fixing portion and a second lower fixing portion at upper and lower ends thereof respectively, the synchronizing assembly comprises a first tensioning piece, a first pulley and a second pulley, and the first tensioning piece sequentially passes through the first upper fixing portion, the first pulley, the second pulley and the second lower fixing portion.

As a further improvement of an embodiment of the present invention, the first tensioning piece comprises a first section between the first upper fixing portion and the first pulley, and a second section between the second pulley and the second lower fixing portion, and the first section and the second section extend in the vertical direction.

As a further improvement of an embodiment of the present invention, the synchronizing assembly comprises a third pulley and a fourth pulley, and the first tensioning piece sequentially pass through the first upper fixing portion, the first pulley, the third pulley, the fourth pulley, the second pulley and the second lower fixing portion.

As a further improvement of an embodiment of the present invention, the first tensioning piece comprises a third section between the first pulley and the third pulley, a fourth section between the third pulley and the fourth pulley, and a fifth section between the fourth pulley and the second pulley, the fourth section extends in the vertical direction, the fifth section extends in a horizontal direction, and a certain angle is formed between the extending direction of the third section and the horizontal direction.

As a further improvement of an embodiment of the present invention, the synchronizing assembly further comprises a second tensioning piece, a fifth pulley and a sixth pulley, and the second tensioning piece passes through the first lower fixing portion, the fifth pulley, the sixth pulley and the second upper fixing portion in sequence.

As a further improvement of an embodiment of the present invention, the second tensioning piece comprises a sixth section between the first lower fixing portion and the fifth pulley, and a seventh section between the sixth pulley and the second upper fixing portion, and the sixth section and the seventh section extend in the vertical direction.

As a further improvement of an embodiment of the present invention, the synchronizing assembly comprises a seventh pulley and an eighth pulley, and the second tensioning piece sequentially passes through the first lower fixing portion, the fifth pulley, the seventh pulley, the eighth pulley, the sixth pulley and the second upper fixing portion.

As a further improvement of an embodiment of the present invention, the second tensioning piece comprises an eighth section between the fifth pulley and the seventh pulley, a ninth section between the seventh pulley and the eighth pulley, and a tenth section between the eighth pulley and the sixth pulley, the ninth section extends in the vertical direction, the eighth section extends in the horizontal direction, and a certain angle is formed between the extending direction of the tenth section and the horizontal direction.

As a further improvement of an embodiment of the present invention, a first end of an elastic assembly is provided at an end portion of the rail groove located at a supporting surface of the rack body, and a second end of the elastic assembly is connected with the sliding plate and gives an elastic restoring force towards the first end of the elastic assembly to the sliding plate.

To achieve one of the above objects, an embodiment of the present invention provides a refrigerator comprising storage compartments in different temperature regions, and doors for opening and closing the storage compartments, wherein the refrigerator further comprises the self-balancing adjustable rack device according to claim 1, and the self-balancing adjustable rack device is provided in at least one storage compartment of the refrigerator.

Compared with a prior art, in the self-balancing adjustable rack device and the refrigerator having the same according to the present invention, a synchronizing assembly is arranged to provide pulling forces for two sides of a rack assembly, such that movement of the two sides of the rack assembly is effectively controlled while the rack assembly is guaranteed to have a certain bearing performance in an up-down moving process, displacements thereof are kept the same all the time, and a rack body is prevented from being overturned.

DETAILED DESCRIPTION

Hereinafter, the present invention will be described in detail in conjunction with specific embodiments shown in the accompanying drawings. However, these embodiments have no limitations on the present invention, and any transformations of structure, method, or function made by persons skilled in the art according to these embodiments fall within the protection scope of the present invention.

Figure 1:
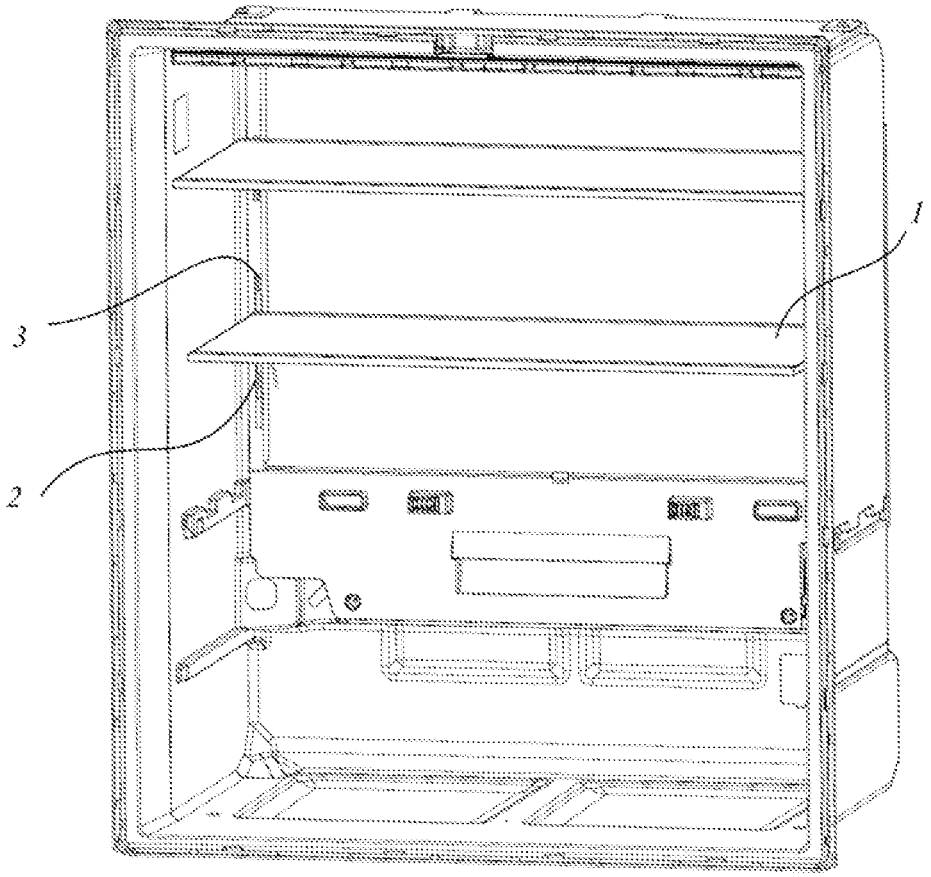
FIG. 1 is a schematic mounting diagram of an adjustable rack device in a refrigerator according to an embodiment of the present invention.
Figure 2:
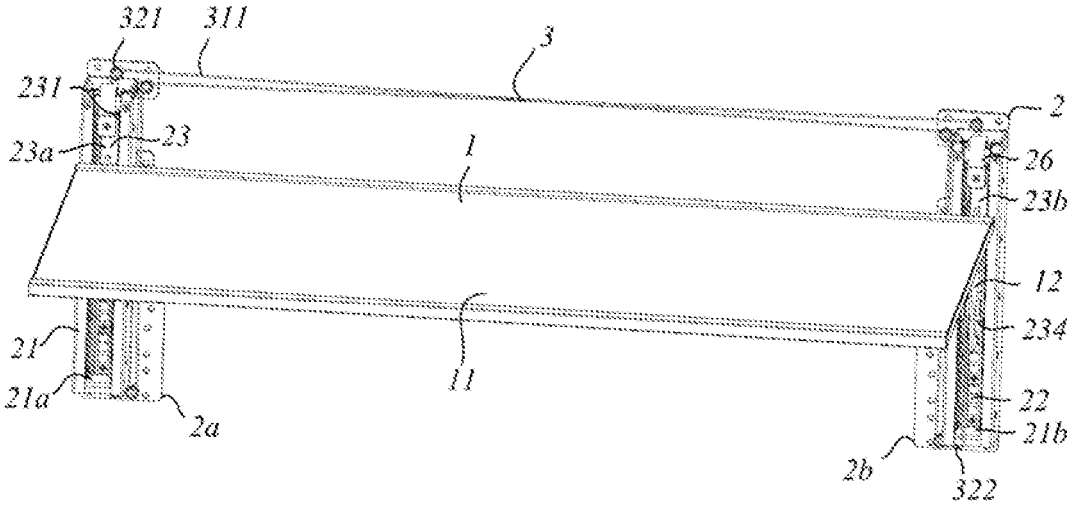
FIG. 2 is a schematic diagram of an assembled self-balancing adjustable rack device according to an embodiment of the present invention.

For example, in the present embodiment, a rack device is provided in a refrigerating compartment of a refrigerator; as shown in FIGS. 1 and 2, the rack device includes a rack assembly 1, a slide rail assembly 2 and a synchronizing assembly 3, the slide rail assembly 2 is provided at a rear panel of a refrigerating compartment cabinet, the synchronizing assembly 3 is provided on the rear panel of the refrigerating compartment cabinet or on the slide rail assembly 2, the rack assembly 1 is fitted with the slide rail assembly 2 and provided in a storage space of the refrigerating compartment in a height-adjustable manner, and the whole rack assembly 1 can be kept balanced during height adjustment through fitting with the synchronizing assembly 3. One or more rack assemblies 1 can be provided, and one or more slide rail assemblies 2 can be provided.

As shown in FIG. 1, in the present embodiment, the slide rail assembly 2 is arranged in a vertical direction of the refrigerating compartment, and when the rack assembly 1 is assembled to the slide rail assembly 2 and is stationary relative to the slide rail assembly 2, a rack body 11 of the rack assembly 1 is arranged horizontally. When the rear panel of the refrigerating compartment cabinet is vertically provided, the rack body 11 is perpendicular to the rear panel. In this way, an article placed on the rack body 11 can be more stable.

In the present embodiment, the rack assembly 1 is movable on the slide rail assembly 2, that is, movable in the vertical direction on the refrigerating compartment cabinet. The plurality of rack assemblies 1 can be moved to adjust distances therebetween and distances between the rack assemblies 1 and top and bottom boards of the refrigerating compartment cabinet to accommodate to store more articles with different heights. In this process, the synchronizing assembly 3 is connected with two ends of the rack assembly 1 to achieve an effect of balancing the rack assembly 1, such that the rack assembly is more stable in an up-down moving process.

As shown in FIG. 2, in the present embodiment, the rack assembly 1 includes the rack body 11 and at least two brackets 12. The brackets 12 are fixed to both sides of the rack body 11 respectively to improve stability of an overall structure. Certainly, in other embodiments, there may exist more than three brackets 12 to further keep stability of the rack body 11 during movement.

In the present embodiment, the slide rail assembly 2 includes a rail groove 21, a stop position 22, a sliding plate 23, and an elastic assembly 26.

Further, in the present embodiment, the slide rail assembly 2 includes a first slide rail assembly 2*a* and a second slide rail assembly 2*b* provided on both sides of the rack body 11 and fitted with the brackets 12, and it may be understood that the first slide rail assembly 2*a* includes a first rail groove 21*a* and a first sliding plate 23*a*, and the second slide rail assembly 2*b* includes a second rail groove 21*b* and a second sliding plate 23*b*. As described above, the slide rail assembly 2 is arranged in the vertical direction, and the above-described rail groove 21 and the sliding plate 23 in sliding fit in the rail groove 21 are also arranged in the vertical direction.

Figure 3:
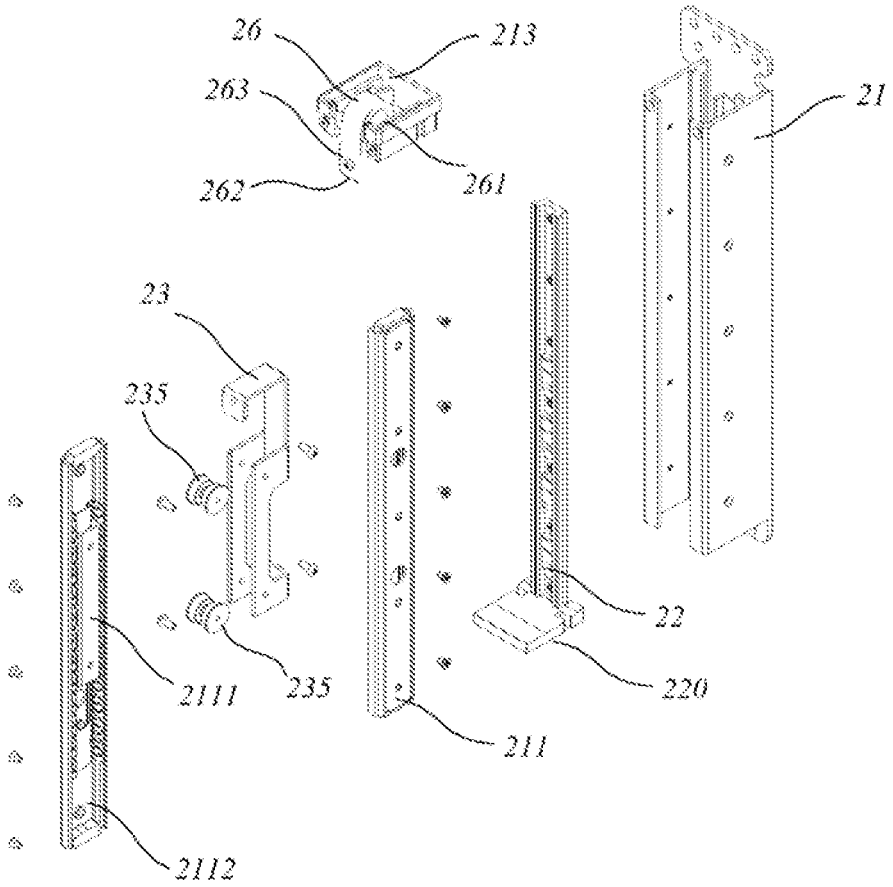
FIG. 3 is a schematic partial exploded structural diagram of a rail groove of a self-balancing adjustable rack device according to an embodiment of the present invention.

As shown in FIGS. 2 and 3, the stop position 22 and the sliding plate 23 are provided inside the rail groove 21, and the sliding plate 23 is slidably connected to the rail groove 21.

The rail groove 21 is provided with at least two stop positions 22 at intervals in the vertical direction, and density of the stop positions can be controlled according to an application requirement of the adjustable rack device, such that the bracket 12 can be selectively limited and fixed to the stop positions. In the present embodiment, the stop position 22 is provided close to a back surface of the rail groove 21. Certainly, in other embodiments, the stop position 22 may be provided close to a side surface of the rail groove 21.

In the present embodiment, when the rail groove 21 is arranged in the vertical direction, the stop position 22 is provided in a strip-shaped stop portion 220, and the strip-shaped stop portion 220 is provided close to the back surface in the rail groove 21, such that relative movement between the sliding plate 23 and the rail groove 21 is not affected while a stop effect is kept, and disassembly and replacement can be facilitated. Certainly, other embodiments exist, for example, the stop portions 220 are provided close to two sides inside the rail groove 21, which can also achieve the effect of stopping the bracket 12.

Further, in the present embodiment, a lower end of the stop portion 220 is provided with a supporting groove which can be fixed to a lower port of the rail groove 21, such that a lower end of the rail groove 21 is sealed to limit the sliding plate 23 in the rail groove 21. Further, slide rails 211 are arranged on both sides inside the rail groove 21. Certainly, in other embodiments, such as those in which the stop positions 22 are arranged on both sides inside the rail groove 21, the slide rail 211 may be fixed to the back surface of the rail groove 21.

In the present embodiment, the slide rail 211 includes an inner rail 2111 and an outer rail 2112, and the inner rail 2111 and the outer rail 2112 are slidably connected by balls. The inner rail 2111 is fixed to the sliding plate 23, and the outer rail 2112 is fixedly connected to an inner side wall of the rail groove 21.

The sliding plate 23 can drive the inner rail 2111 to move relative to the outer rail 2112 and the rail groove 21 to which the outer rail is fixed through the balls between the inner rail and the outer rail 2112 when the sliding plate is forced to move up and down.

In the present embodiment, a roller 235 in snapped connection with a hook of the bracket 12 is provided inside the sliding plate 23, two ends of the roller 235 are fixed in a groove of the sliding plate 23, the roller 235 can rotate with a connection line of the two fixed ends thereof as an axis, and the fitting structure of the roller 235 and the hook can provide a supporting force for the sliding plate 23 in the vertical direction during up-down movement of the rack assembly 1.

Further, as shown in FIG. 3, the elastic assembly 26 is also connected with the sliding plate 23 and provides an acting force for the sliding plate 23, the elastic assembly 26 has a first end 261 and a second end 262, the first end 261 of the elastic assembly is provided at a top end of the rail groove 21, and the second end 262 of the elastic assembly is in a free state, such that the elastic assembly 26 can be elastically deformed by applying a pulling force, and then, the second end 262 can be pulled to be connected to a top end of the sliding plate 23, thereby providing an elastic restoring force towards the first end 261 of the elastic assembly 26 for the sliding plate 23.

In order to protect an appearance and function of the second end 262 of the elastic assembly, a fixed sheet 263 is provided at a portion where the second end 262 of the elastic assembly is fixedly overlapped with the sliding plate 23, and screw holes with a same size are provided at corresponding positions of the second end 262 of the elastic assembly, an upper end of the sliding plate 23, and the fixed sheet 263 respectively, such that an integral structure is formed by screw fixation, and service life of the elastic assembly 26 is prolonged.

In the present embodiment, the rail groove 21 further includes an elastic assembly fixing base 213 for fixing the elastic assembly 26, and the elastic assembly fixing base 213 is provided therein with an accommodating portion capable of accommodating the first end 261 of the elastic assembly. In the present embodiment, a transverse rod is provided in the accommodating portion, the elastic assembly 26 is configured in a hollow winding shape, the transverse rod is inserted into the hollow portion, and two ends of the transverse rod are fixedly connected to a housing of the elastic assembly fixing base 213, such that the elastic assembly 26 is connected to the elastic assembly fixing base 213.

Further, the elastic assembly fixing base 213 can be in snapped connection with the top end of the rail groove 21, and the elastic assembly fixing base 213, the rail groove 21 and the supporting groove at the bottom of the stop portion 220 form a closed space, such that a moving position of the sliding plate 23 is limited, and the sliding plate is prevented from being separated from an upper port and the lower port of the rail groove 21. The slide rail 211, the sliding plate 23, the roller 235 inside the sliding plate 23, and the second end 262 of the elastic assembly 26 connected to the sliding plate 23 are fixed inside the closed structure.

Figure 4:
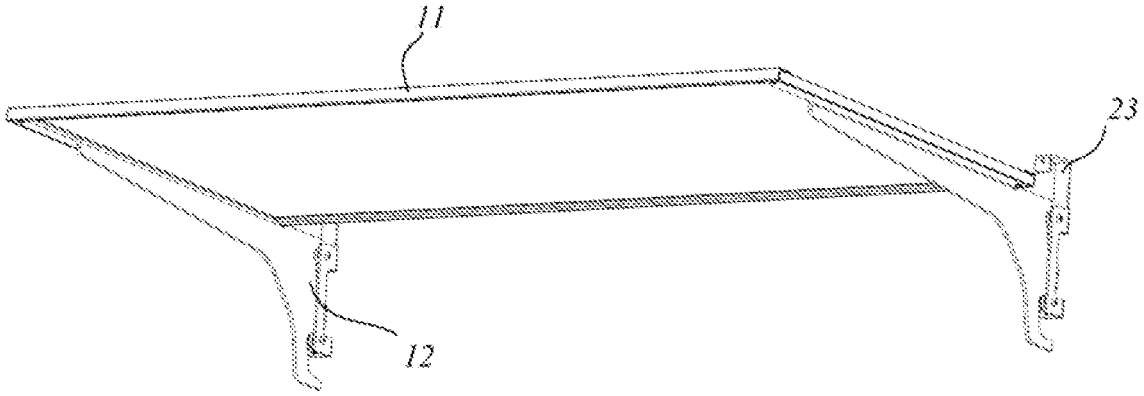
FIG. 4 is a schematic assembly diagram of a rack assembly and a sliding plate of a self-balancing adjustable rack device according to an embodiment of the present invention.

As shown in FIGS. 2 to 4, further, the sliding plate 23 is mounted in the corresponding rail groove 21, such that the hook on the bracket 12 of the rack assembly 1 is fitted with the roller 235 inside the sliding plate 23, and then, the rack assembly 1 can be assembled to the slide rail assembly 2. It may be appreciated that the rail groove 21 is perpendicular to the rack body 11 after the rack assembly 1 is assembled to the slide rail assembly 2 and gets into a relatively stationary state. The rack body 11 is relatively fixed to the sliding plate 23 by the bracket 12, and the sliding plate 23 is slidably assembled onto the rail groove 21.

Thus, convenient and labor-saving effects may be achieved during adjustment of the rack assembly 1; however, the whole rack body 11 may not be balanced due to unequal displacements of the two sliding plates 23 during the adjustment, and therefore, the rack device is further provided with the synchronizing assembly 3 in the present embodiment.

Figure 5:
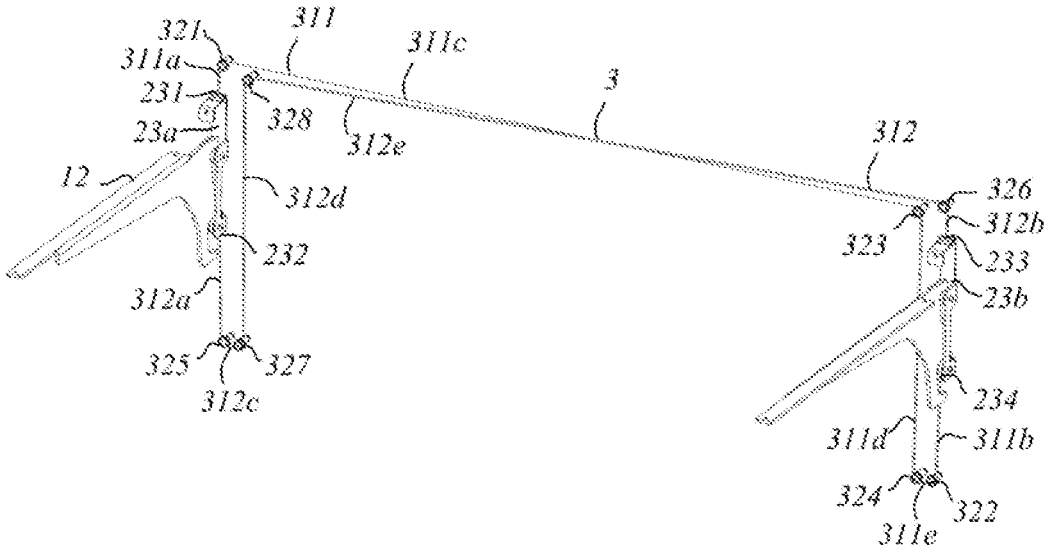
FIG. 5 is a schematic diagram of a fitting structure of a pulley, a tensioning piece, a sliding plate and a bracket of a self-balancing adjustable rack device according to an embodiment of the present invention.

As shown in FIG. 5, in the present embodiment, the first sliding plate **23*a* includes a first upper fixing portion 231 and a first lower fixing portion 232 at an upper end and a lower end thereof respectively, the second sliding plate 23*b* includes a second upper fixing portion 233 and a second lower fixing portion 234 at an upper end and a lower end thereof respectively, the synchronizing assembly 3 includes a first tensioning piece 311, a first pulley 321, and a second pulley 322, one end of the first tensioning piece 311 is fixed to the first upper fixing portion 231, and the other end thereof is fixed to the second lower fixing portion 234 via the first pulley 321 and the second pulley 322, such that when the first sliding plate 23*a* moves upwards, the second sliding plate 23*b* maintains the same moving direction and displacement as the first sliding plate 23*a* through transmission of the first pulley 321 and the second pulley 322 in cooperation with movement of the first tensioning piece 311**.

The arrangement of the above-mentioned synchronizing assembly 3 can solve problems that when the first sliding plate **23*a* and the second sliding plate 23*b* drive both sides of the bracket 12 to move up and down, flexible movement positions cause unequal displacement lengths of the sliding plates, and the bracket 12 asynchronously moves to incline the rack body 11 connected thereto, thus bringing inconvenience to a user; meanwhile, the first tensioning piece 311 is arranged to provide a vertical pulling force for the first sliding plate 23*a*, such that the first sliding plate 23*a*** is more convenient during movement, thus improving user experiences.

More specifically, the first tensioning piece 311 includes a first section **311*a* between the first upper fixing portion 231** and the first pulley 321, and a second section 311*b* between the second pulley 322 and the second lower fixing portion 234; for example, when the first sliding plate 23*a* is vertically displaced upwards by a displacement length L0, the first section 311*a* is shortened by a length L0, and since the first pulley 321 and the second pulley 322 are fixed, a distance between the two pulleys is constant, and a length of a part of the first tensioning piece 311 between the two pulleys is constant, the second section 311*b* is extended by the same length L0, thereby ensuring that the second sliding plate 23*b* can be vertically displaced by the same length L0 as the first sliding plate 23*a*.

Preferably, as shown in FIGS. 2 and 5, the first section 311*a* and the second section 311*b* extend in the vertical direction; certainly, in other embodiments, when the rail groove 21 and the sliding plate 23 therein are not vertically arranged, the first section 311*a* and the second section 311*b* may extend in another direction, and the extending direction of the first section 311*a* and the second section 311*b* may be any direction the same as a moving direction of the first sliding plate 23*a* and the second sliding plate 23*b*. It may be appreciated that in the present embodiment, when the first section 311*a* and the second section 311*b* do not extend in the vertical direction, or in other embodiments in which the rail groove 21 is not arranged in the vertical direction, when the first section 311*a* and the second section 311*b* are not in the moving direction of the first sliding plate 23*a* and the second sliding plate 23*b*, the first tensioning piece 311 may provide a component force in a horizontal direction or perpendicular to the moving direction of the sliding plate 23 for the sliding plate 23 connected thereto, such that the sliding plate 23 is pressed against the rail groove 21 to generate a larger sliding friction force, which not only shortens service life of the device, but also makes a sliding process difficult.

In the present embodiment, in order to further avoid that the first tensioning piece 311 interferes with the rail groove 21 or the sliding plate 23, thereby shortening service life of the first tensioning piece 311, further, the synchronizing assembly 3 includes a third pulley 323 and a fourth pulley 324, one end of the first tensioning piece 311 is fixed to the first upper fixing portion 231 of the first sliding plate 23*a*, and the other end thereof is fixed to the second lower fixing portion 234 of the second sliding plate 23*b* via the first pulley 321, the third pulley 323, the fourth pulley 324 and the second pulley 322; the first tensioning piece 311 includes, in addition to the first section 311*a* and the second section 311*b*, a third section 311*c* between the first pulley 321 and the third pulley 323, a fourth section 311*d* between the third pulley 323 and the fourth pulley 324, and a fifth section 311*e* between the fourth pulley 324 and the second pulley 322.

Preferably, in order to avoid wear caused by interference between the first tensioning piece 311 and other assemblies of the rack device, the fourth section 311*d* extends in the vertical direction, and the fifth section 311*e* extends in the horizontal direction; certainly, in other embodiments, especially in embodiments where the slide rail assembly 2 is not arranged in the vertical direction, the fourth section 311*d* may extend in other directions as long as the fourth section is kept parallel to the rail groove 21 and the sliding plate 23 in the slide rail assembly 2, or the fourth section has other interference-avoiding angles relative to the vertical direction, and it may be understood that the fifth section 311*e* may be arranged in other ways in other embodiments.

As shown in FIG. 5, in order to better maintain synchronism of the first sliding plate 23*a* and the second sliding plate 23*b* during movement, a second tensioning piece 312, a sixth pulley 326 and a fifth pulley 325 corresponding to the first tensioning piece 311, the first pulley 321 and the second pulley 322 may be provided between the second upper fixing portion 233 of the second sliding plate 23*b* and the first lower fixing portion 232 of the first sliding plate 23*a*, and thus, one end of the second tensioning piece 312 is fixed to the first lower fixing portion 232, and the other end thereof is fixed to the second upper fixing portion 233 via the fifth pulley 325 and the sixth pulley 326; the second tensioning piece 312 includes a sixth section 312*a* between the first lower fixing portion 232 and the fifth pulley 325, and a seventh section 312*b* between the sixth pulley 326 and the second upper fixing portion 233, and preferably, the sixth section 312*a* and the seventh section 312*b* extend in the vertical direction.

Similar to the first tensioning piece 311, the first pulley 321, and the second pulley 322, when the first sliding plate 23*a* moves upwards in the vertical direction, the sixth section 312*a* is extended, the seventh section 312*b* is shortened, and an extended length of the sixth section 312*a* is the same as a shortened length of the seventh section 312*b*, thereby enabling the second sliding plate 23*b* fixed to the seventh section 312*b* to be displaced by the same length as the first sliding plate 23*a* in the vertical direction.

It may be appreciated that in order to avoid interference between the second tensioning piece 312 and other assemblies of the rack device, the synchronizing assembly 3 further includes a seventh pulley 327 and an eighth pulley 328, and further, one end of the second tensioning piece 312 is fixed to the first lower fixing portion 232 of the first sliding plate 23*a*, and the other end thereof is fixed to the second upper fixing portion 233 of the second sliding plate 23*b* via the fifth pulley 325, the seventh pulley 327, the eighth pulley 328 and the sixth pulley 326.

More specifically, the second tensioning piece 312 includes an eighth section 312*c* between the fifth pulley 325 and the seventh pulley 327, a ninth section 312*d* between the seventh pulley 327 and the eighth pulley 328, and a tenth section 312*e* between the eighth pulley 328 and the sixth pulley 326, and preferably, the ninth section 312*d* extends in the vertical direction and the eighth section 312*c* extends in the horizontal direction.

In the present embodiment, the first tensioning piece 311, the second tensioning piece 312 and corresponding pulley sets together form the synchronizing assembly 3; however, when the third section 311*c* and the tenth section 312*e* are in a horizontal state or have other same angles relative to the horizontal direction during actual movement, interference may exist and results in friction between the first tensioning piece 311 and the second tensioning piece 312 and thus wear, and therefore, an angle or distance may be kept between the third section 311*c* and the tenth section 312*e*, thereby avoiding interference; in the present embodiment, the third pulley 323 is located below the sixth pulley 326 on a side close to the first sliding plate 23*a*, the eighth pulley 328 is located below the first pulley 321 on a side close to the second sliding plate 23*b*, such that the third section 311*c* and the tenth section 312*e* form an X-shaped cross structure, thus further reducing the interference between the first tensioning piece 311 and the second tensioning piece 312. It may be understood that the above technical effects can be achieved by fixing the third pulley 323 and the eighth pulley 328 at corresponding positions below the sixth pulley 326 and the first pulley 321 respectively. Correspondingly, in the present embodiment, the seventh pulley 327 is fixed to a side of the fifth pulley 325 close to the second sliding plate 23*b*, and the fourth pulley 324 is fixed to a side of the second pulley 322 close to the first sliding plate 23*a*.

Certainly, other embodiments exist; for example, the third pulley 323 is fixed below the sixth pulley 326 on a side apart from the first sliding plate 23*a*, the fourth pulley 324 is fixed to a side of the second pulley 322 apart from the first sliding plate 23*a*, and correspondingly, the eighth pulley 328 is fixed below the first pulley 321 on a side apart from the second sliding plate 23*b*, the seventh pulley 327 is fixed to a side of the fifth pulley 325 apart from the second sliding plate 23*b*, or the third pulley 323 and the eighth pulley 328 are fixed to corresponding positions above the sixth pulley 326 and the first pulley 321 respectively, such that the third section 311*c* and the tenth section 312*e* form an X-shaped cross structure, which can achieve the above-mentioned desired technical effects.

In the present embodiment, the pulleys are provided on the corresponding rail grooves 21, and more specifically, the first pulley 321 and the eighth pulley 328 are provided on a surface of the first rail groove 21*a* above the first sliding plate 23*a*, the fifth pulley 325 and the seventh pulley 327 are provided on a surface of the first rail groove 21*a* below the first sliding plate 23*a*, and correspondingly, the sixth pulley 326 and the third pulley 323 as well as the second pulley 322 and the fourth pulley 324 are provided on surfaces of the second rail groove 21*b* above and below the second sliding plate 23*b* respectively, which not only can improve stability of a pulley structure, but also facilitates mounting and dismounting processes of the rack device and prevents an inner wall of the refrigerator from being damaged.

In the following, by way of example, synchronous movement of the rack assembly 1 and the sliding plate 23 in the slide rail assembly 2 under an action of the synchronizing assembly 3 is described; as shown in FIGS. 2 and 5, when the rack body 11 is lifted to drive the roller 235 and the sliding plate 23 to vertically displace upwards by a first length L1 by the brackets 12 and the hooks thereof on both sides of the rack body 11, the first section 311*a* of the first tensioning piece 311 fixed on the upper end of the first sliding plate 23*a* is also shortened by the first length L1, the second section 311*b* is extended by the first length L1 through transmission of the third section 311*c*, the fourth section 311*d* and the fifth section 311*e*, and correspondingly, when the second sliding plate 23*b* connected with the first sliding plate 23*a* through the rack assembly 1 displaces upwards by the first length L1, in the second tensioning piece 312, the sixth section 312*a* is also extended by the first length L1 through transmission of the seventh section 312*b*, the tenth section 312*e*, the ninth section 312*d* and the eighth section 312*c*. That is, the first sliding plate 23*a* and the second sliding plate 23*b* are controlled by cross linkage of the first tensioning piece 311 and the second tensioning piece 312, and thus have the same vertical displacement length.

Further, when the sliding plates 23 are fixed in the rail grooves 21, the first upper fixing portion 231, the first lower fixing portion 232, the second upper fixing portion 233 and the second lower fixing portion 234 are located at center positions of side edges of the upper and lower ends of the first sliding plate 23*a* and the second sliding plate 23*b* close to the rail grooves 21 respectively, thereby avoiding that the sliding plate 23 loses balance due to pulling of the first tensioning piece 311 and the second tensioning piece 312 during the up-down movement.

In the present embodiment, the first tensioning piece 31 and the second tensioning piece 32 are configured as synchronous steel wires which have high structural strength and long service life, thus providing better pulling force and synchronization effects for the sliding plate 23.

Figure 6:
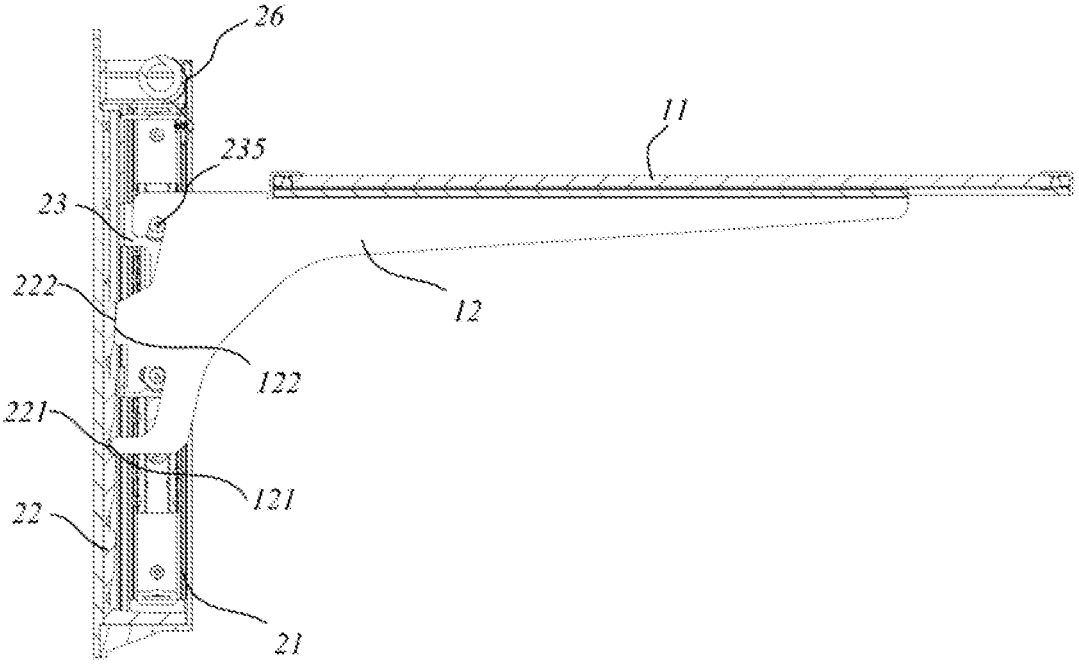
FIG. 6 is a schematic diagram of a self-balancing adjustable rack device in a stationary state according to an embodiment of the present invention.
Figure 7:
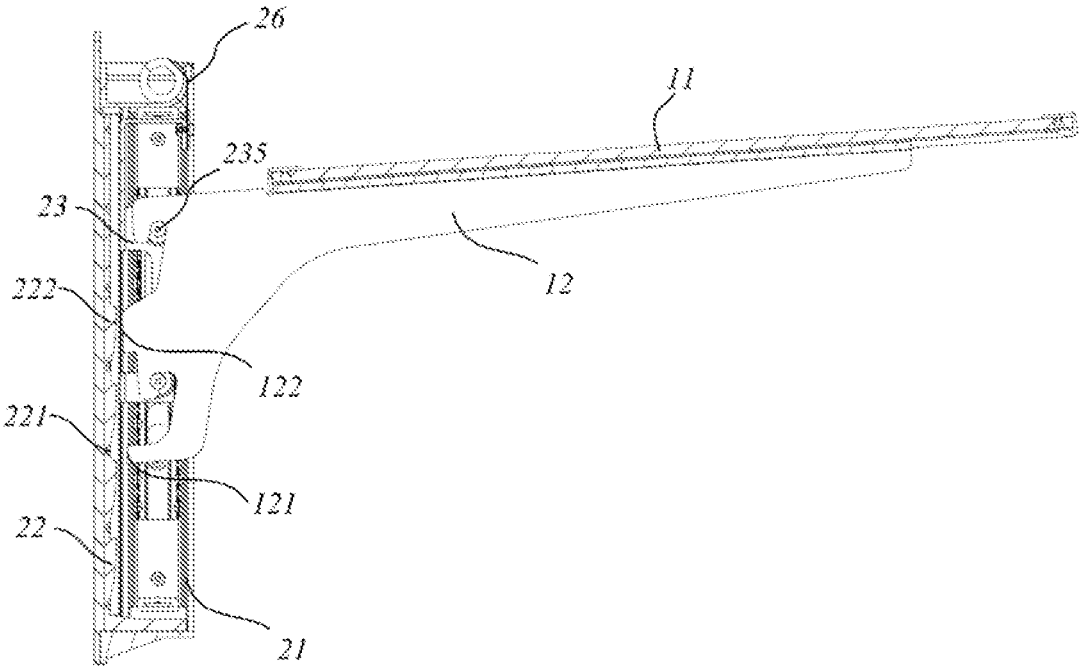
FIG. 7 is a schematic diagram of a self-balancing adjustable rack device in a moving state according to an embodiment of the present invention.

Referring to FIGS. 6 and 7, fixation of the rack assembly 1 on the slide rail assembly 2 is mainly realized by fitting of the bracket 12 of the rack assembly 1 with the stop position 22 and the roller 235 inside the slide rail assembly 2.

FIG. 6 shows the adjustable rack device in the stationary state, a first supporting portion 121 is provided at one end of the bracket 12 apart from a supporting surface of the rack body 11 in the vertical direction, the first supporting portion 121 is preferably designed into an L-shaped handle structure, the first supporting portion and a first fitting portion 221 in the stop position 22 provided inside the rail groove 21 are limited and fixed, and preferably, the first fitting portion 221 is configured as a groove which is configured to be fitted with upper and lower end surfaces of the L-shaped handle structure and has an L-shaped cross section.

Further, a second supporting portion 122 is provided at a position of the bracket 12 close to the supporting surface of the rack body 11 in the vertical direction, and configured as a protrusion which has an inclined surface inclined relative to the vertical direction, the inclined surface and a second fitting portion 222 in the stop position 22 have a self-locking angle, and the self-locking angle can provide the rack assembly 1 in a non-bearing state with a friction force, such that relative movement between the rack assembly and the strip-shaped stop portion 220 is avoided, and on the other hand, the fitting structure can reduce wear of the first supporting portion 121 and the first fitting portion 221 to a certain extent.

In the stationary state, the first fitting portion 221 in the stop position 22 and the first supporting portion 121 on the bracket 12 are limited and fixed, and at this point, the first fitting portion is in surface contact with a lower end surface of the first supporting portion 121, and meanwhile, the second supporting portion 122 and the second fitting portion 222 are self-locked, and when a surface of the rack body 11 bears a load, due to a lever principle, the first supporting portion 121 and the second supporting portion 122 provide horizontal pressure towards an interior of the stop position 22 to the first fitting portion 221 and the second fitting portion 222 respectively, and correspondingly obtain opposite supporting forces provided by the first fitting portion 221 and the second fitting portion 222 respectively, and at this point, due to a friction coefficient between the supporting portion and the stop position 22, the friction force of contact portions is increased, such that an overall structure of the rack device is stable.

When the rack body 11 is lifted up in the stationary state, the rack assembly 1 is rotated by a certain angle with the roller 235 limited and fixed onto the bracket 12 and close to one end of the supporting surface of the rack body 11 as a rotation axis, and the rack device is switched to a moving state, as shown in FIG. 7.

At this point, the first supporting portion 121 is separated from the first fitting portion 221, and the second supporting portion 122 is separated from the second fitting portion 222, thereby releasing the limitation and self-locking structure; further, the rack body 11 is lifted or pushed down in the vertical direction, the sliding plate 23 fixed to the bracket 12 can move up and down in the vertical direction along the rail groove 21, and in the moving process, the elastic assembly 26 fixed to the top end of the rail groove 21 continuously provides the elastic restoring force for the sliding plate 23, such that a user can adjust the position of the rack assembly 1 only by overcoming a sliding friction force in the rail groove 21.

Compared with a prior art, in the present embodiment, due to the simultaneous arrangement of the elastic assembly 26 and the synchronizing assembly 3, during the position adjustment of the rack assembly 1, the sliding plate 23 can be continuously provided with the pulling force, such that the two sides of the rack body 11 can be balanced, and meanwhile, even when a heavy article exists on the supporting surface of the rack body 11, the position of the rack assembly 1 can be adjusted only by simple and convenient operations, such as up-down lifting, pulling, or the like.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments may be combined properly to form other embodiments which may be understood by those skilled in the art.

A series of the detailed descriptions set forth above is merely specific description of feasible embodiments of the present invention, and is not intended to limit the protection scope of the present invention. Equivalent embodiments or modifications made within the spirit of the present invention shall fall within the protection scope of the present invention.

What is claimed is:

1. A self-balancing adjustable rack device, comprising a rack assembly, a slide rail assembly and a synchronizing assembly;

wherein the rack assembly comprises a rack body and a bracket;

the slide rail assembly comprises a first slide rail assembly and a second slide rail assembly located on two sides of the rack body, the first slide rail assembly comprises a first rail groove and a first sliding plate in sliding fit with the first rail groove and fixedly connected with the bracket, the second slide rail assembly comprises a second rail groove and a second sliding plate in sliding fit with the second rail groove and fixedly connected with the bracket, and the first rail groove and the second rail groove are arranged in a vertical direction and perpendicular to the rack body;

at least two stop positions are arranged in each of the first rail groove and the second rail groove, the at least two stop positions are arranged at intervals in the vertical direction, and the bracket and the stop positions can be selectively limited and fixed;

the first sliding plate comprises a first upper fixing portion and a first lower fixing portion at upper and lower ends thereof respectively, and the second sliding plate comprises a second upper fixing portion and a second lower fixing portion at upper and lower ends thereof respectively;

the synchronizing assembly comprises a first tensioning piece, a first pulley and a second pulley, and the first tensioning piece sequentially passes through the first upper fixing portion, the first pulley, the second pulley and the second lower fixing portion;

wherein the synchronizing assembly comprises a third pulley and a fourth pulley, and the first tensioning piece sequentially pass through the first upper fixing portion, the first pulley, the third pulley, the fourth pulley, the second pulley and the second lower fixing portion.

2. The self-balancing adjustable rack device according to claim 1, wherein the first tensioning piece comprises a first section between the first upper fixing portion and the first pulley, and a second section between the second pulley and the second lower fixing portion, and the first section and the second section extend in the vertical direction.

3. The self-balancing adjustable rack device according to claim 1, wherein the first tensioning piece comprises a third section between the first pulley and the third pulley, a fourth section between the third pulley and the fourth pulley, and a fifth section between the fourth pulley and the second pulley, the fourth section extends in the vertical direction, the fifth section extends in a horizontal direction, and a certain angle is formed between the extending direction of the third section and the horizontal direction.

4. The self-balancing adjustable rack device according to claim 1, wherein the synchronizing assembly further comprises a second tensioning piece, a fifth pulley and a sixth pulley, and the second tensioning piece passes through the first lower fixing portion, the fifth pulley, the sixth pulley and the second upper fixing portion in sequence.

5. The self-balancing adjustable rack device according to claim 4, wherein the second tensioning piece comprises a sixth section between the first lower fixing portion and the fifth pulley, and a seventh section between the sixth pulley and the second upper fixing portion, and the sixth section and the seventh section extend in the vertical direction.

6. The self-balancing adjustable rack device according to claim 5, wherein the synchronizing assembly comprises a seventh pulley and an eighth pulley, and the second tensioning piece sequentially passes through the first lower fixing portion, the fifth pulley, the seventh pulley, the eighth pulley, the sixth pulley and the second upper fixing portion.

7. The self-balancing adjustable rack device according to claim 6, wherein the second tensioning piece comprises an eighth section between the fifth pulley and the seventh pulley, a ninth section between the seventh pulley and the eighth pulley, and a tenth section between the eighth pulley and the sixth pulley, the ninth section extends in the vertical direction, the eighth section extends in the horizontal direction, and a certain angle is formed between the extending direction of the tenth section and the horizontal direction.

8. A refrigerator comprising storage compartments in different temperature regions, and doors for opening and closing the storage compartments, wherein the refrigerator further comprises the self-balancing adjustable rack device according to claim 1, and the self-balancing adjustable rack device is provided in at least one storage compartment of the refrigerator.

9. A self-balancing adjustable rack device, comprising a rack assembly, a slide rail assembly and a synchronizing assembly;

wherein the rack assembly comprises a rack body and a bracket;

the slide rail assembly comprises a first slide rail assembly and a second slide rail assembly located on two sides of the rack body, the first slide rail assembly comprises a first rail groove and a first sliding plate in sliding fit with the first rail groove and fixedly connected with the bracket, the second slide rail assembly comprises a second rail groove and a second sliding plate in sliding fit with the second rail groove and fixedly connected with the bracket, and the first rail groove and the second rail groove are arranged in a vertical direction and perpendicular to the rack body;

at least two stop positions are arranged in each of the first rail groove and the second rail groove, the at least two stop positions are arranged at intervals in the vertical direction, and the bracket and the stop positions can be selectively limited and fixed;

the first sliding plate comprises a first upper fixing portion and a first lower fixing portion at upper and lower ends thereof respectively, and the second sliding plate comprises a second upper fixing portion and a second lower fixing portion at upper and lower ends thereof respectively;

the synchronizing assembly comprises a first tensioning piece, a first pulley and a second pulley, and the first tensioning piece sequentially passes through the first upper fixing portion, the first pulley, the second pulley and the second lower fixing portion;

wherein a first end of an elastic assembly is provided at an end portion of the rail groove located at a supporting surface of the rack body, and a second end of the elastic assembly is connected with the sliding plate and gives an elastic restoring force towards the first end of the elastic assembly to the sliding plate.

10. The self-balancing adjustable rack device according to claim 9, wherein the first tensioning piece comprises a first section between the first upper fixing portion and the first pulley, and a second section between the second pulley and the second lower fixing portion, and the first section and the second section extend in the vertical direction.

11. The self-balancing adjustable rack device according to claim 9, wherein the synchronizing assembly comprises a third pulley and a fourth pulley, and the first tensioning piece sequentially pass through the first upper fixing portion, the first pulley, the third pulley, the fourth pulley, the second pulley and the second lower fixing portion.

12. The self-balancing adjustable rack device according to claim 11, wherein the synchronizing assembly further comprises a second tensioning piece, a fifth pulley and a sixth pulley, and the second tensioning piece passes through the first lower fixing portion, the fifth pulley, the sixth pulley and the second upper fixing portion in sequence.

13. The self-balancing adjustable rack device according to claim 12, wherein the second tensioning piece comprises a sixth section between the first lower fixing portion and the fifth pulley, and a seventh section between the sixth pulley and the second upper fixing portion, and the sixth section and the seventh section extend in the vertical direction.

14. The self-balancing adjustable rack device according to claim 12, wherein the synchronizing assembly comprises a seventh pulley and an eighth pulley, and the second tensioning piece sequentially passes through the first lower fixing portion, the fifth pulley, the seventh pulley, the eighth pulley, the sixth pulley and the second upper fixing portion.

15. The self-balancing adjustable rack device according to claim 14, wherein the second tensioning piece comprises an eighth section between the fifth pulley and the seventh pulley, a ninth section between the seventh pulley and the eighth pulley, and a tenth section between the eighth pulley and the sixth pulley, the ninth section extends in the vertical direction, the eighth section extends in the horizontal direction, and a certain angle is formed between the extending direction of the tenth section and the horizontal direction.

* * * * *